United States Patent [19]

Morse

[11] 4,213,304

[45] Jul. 22, 1980

[54] BOILER CONTROL SYSTEM

[75] Inventor: Richard H. Morse, Oreland, Pa.

[73] Assignee: Leeds & Northrup Company, North Wales, Pa.

[21] Appl. No.: 963,259

[22] Filed: Nov. 24, 1978

[51] Int. Cl.[3] ..... F01K 3/22

[52] U.S. Cl. ..... 60/664; 60/667

[58] Field of Search ..... 60/660, 663, 624, 667, 60/665; 122/449

[56] References Cited

U.S. PATENT DOCUMENTS

| | | | |
|---|---|---|---|
| 3,802,189 | 4/1974 | Jenkins | 60/665 |
| 4,064,699 | 12/1977 | Martz | 60/667 |
| 4,174,618 | 11/1979 | Jenkins et al. | 60/664 |

*Primary Examiner*—James J. Gill

*Attorney, Agent, or Firm*—William G. Miller, Jr.; Raymond F. MacKay

[57] ABSTRACT

A method and means for controlling the throttle pressure of a fuel fired drum type boiler by controlling the fuel input to the boiler so as to equalize the boiler demand, calculated as the product of a quantity proportional to the rate of energy output from the boiler at the existing throttle pressure times the ratio of the desired throttle pressure to the existing throttle pressure, and the heat released to the boiler by the fuel, calculated as the sum of a quantity proportional to boiler output and the measured rate of change of drum pressure.

9 Claims, 4 Drawing Figures

GENERATION CONTROL
CONTROLLER
AIR FLOW DEMAND
$P_s$
$P_1$
$P_t$
$P_d$
$\dot{P}_d$
$\dot{P}_s$
$e_h$

BOILER CONTROL SYSTEM

BACKGROUND OF THE INVENTION

This invention relates to a control system for controlling the outlet or throttle pressure of a boiler so as to maintain it at a desired value while also maintaining the steam flow to the load, such as turbine input, and the boiler input in balance at the same time. This invention is particularly applicable to the drum type boiler and may be useful in industrial boilers as well as in boilers operated in combination with a turbine in such a way that the throttle valve, which adjusts the flow of steam from the boiler to the turbine, is controlled to adjust the turbine input so as to produce the desired output from the generator driven by the turbine. The control system may be of the type which operates to maintain the throttle pressure constant at a predetermined value under varying load conditions on the turbine-generator or it may be of the type which operates to maintain a constant opening on the throttle valve as the load changes while allowing the throttle pressure to vary with the load changes.

When the fuel supply system for the boiler is of the type which makes it difficult to make a direct measurement of the rate at which heat is supplied to the boiler, it is necessary to make an inferential measurement of the heat input to the boiler. One example of such a system is a coal firing system in which the coal is supplied by a coal mill, particularly when the coal may be changed from one grade to another with the different grades having different BTU content.

The problems which arise when applying prior art control systems to coal fired boilers are discussed in U.S. patent application Ser. No. 892,537 filed by T. W. Jenkins and J. C. Barber, now U.S. Pat. No. 4,174,618. Those inventors have, in that application, described one solution to the problem which arises from the frequently used cascade control system wherein the control loop which involves the secondary controller is not substantially faster than the control loop involving the primary controller so that there tends to be an interaction between the control loops.

The system shown and described in the above mentioned patent application is illustrated in connection with a boiler-turbine system wherein the throttle pressure is maintained constant. Other systems in the prior art such as that described in U.S. Pat. No. 3,802,189 issued to Theron W. Jenkins, Jr. on Apr. 9, 1974, describe a control system for controlling the boiler inputs in a boiler turbine combination operating in a sliding pressure mode with the throttle valve being controlled to maintain the desired generator output. The system of that patent, however, is illustrated with reference only to fuels of the type which are easily metered such as oil or gas.

It is an object of this invention to provide an improved boiler control system which will avoid completely the problems which may arise in the prior art system which utilize cascade control.

SUMMARY OF THE INVENTION

The improved control system of this invention provides a method and means for controlling the boiler outlet or throttle pressure of a boiler where the boiler is of the drum type and is connected to supply steam to a load such as through a throttle valve to a turbine-generator whose output may be controlled by modifying the throttle valve opening. This improved control is obtained by comparing the heat released to the boiler with a quantity indicative of the rate at which energy is put out by the boiler as represented by the ratio of throttle pressure set point to measure throttle pressure multiplied by a quantity representing boiler output (turbine input). Heat release in the boiler is calculated as the sum of the rate of change of drum pressure plus a quantity proportional to boiler output. There is then produced a control of the fuel input to the boiler so as to vary the heat release in accordance with the magnitude of the demand with the response to the throttle pressure set point and to the actual throttle pressure being effectively only to their ratio.

DESCRIPTION OF THE PREFERRED EMBODIMENT

Figures 1, 2:
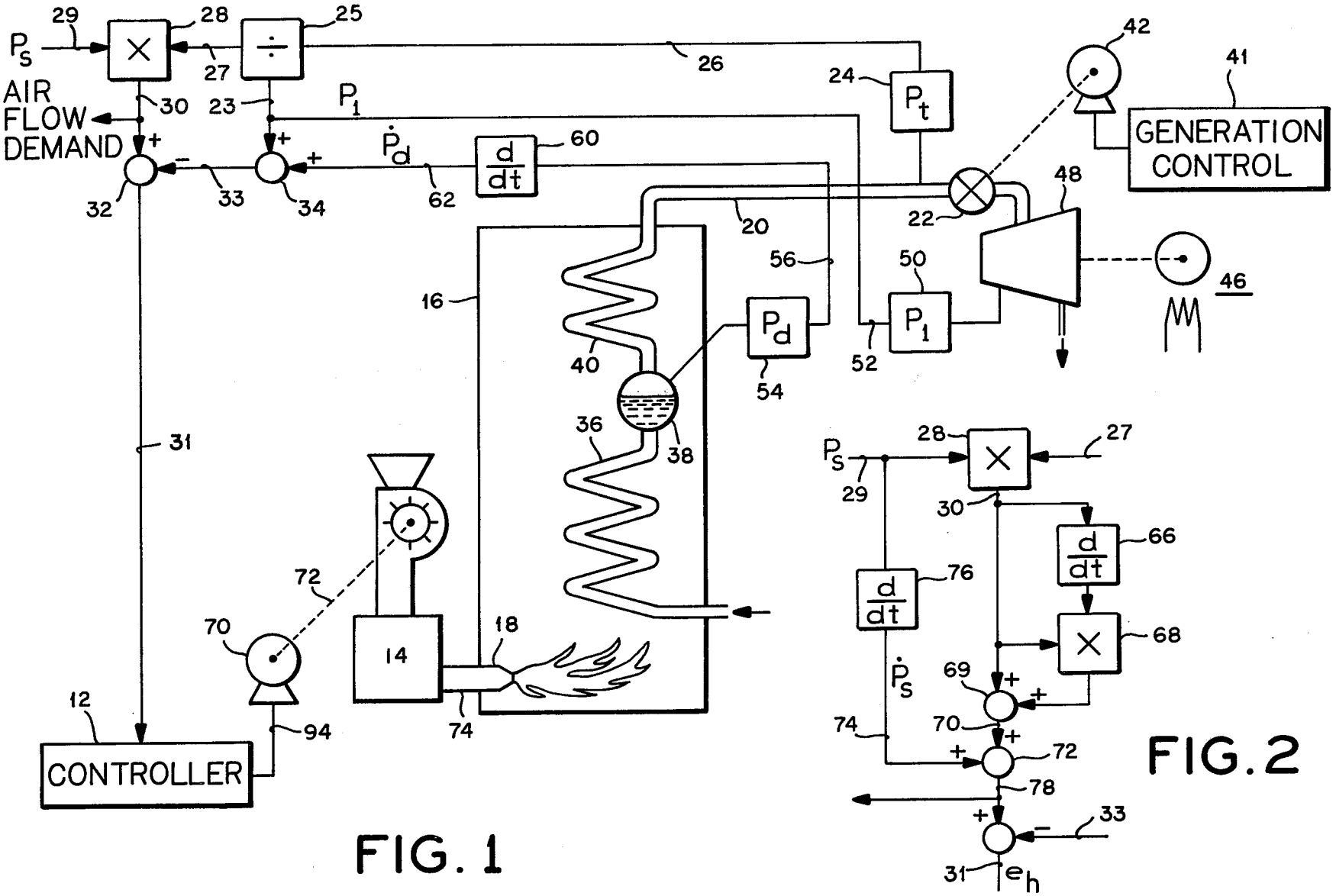
FIG. 1 is a block diagram showing one form of the control system of the present invention.
FIG. 2 is a block diagram showing a variation which is useful for part of the circuit of FIG. 1.

In FIG. 1 the controller 12 is connected so as to control the feed rate from the pulverizing unit of coal mill 14. The coal mill 14 delivers coal to the boiler 16 through pipe 74 and burner 18 so as to provide the heat input to the boiler required to produce steam in the output steam line 20 at the desired pressure and temperature.

The boiler itself is shown as including tube 36 which is supplied by feedwater to be heated sufficiently to produce steam in drum 38. The steam from drum 38 is then superheated in superheater coil 40 which supplies the steam output in line 20.

The throttle pressure $P_t$ is measured in line 20 ahead of throttle valve 22 by the pressure measuring instrument 24 so as to produce on line 26 a signal indicative of the throttle pressure which can then be utilized as one input to the divider 25 which operates to divide it into the other input to the divider on line 23. The signal on line 23 which connects to line 52 is $P_1$ which is indicative of the first stage pressure in the turbine 48 and hence the rate of energy flow from boiler 16. $P_1$ is measured by the measuring device 50. Divider 25 then supplies on its output line 27 a signal proportional to $P_1/P_t$ which is introduced as one input to the multiplier 28. The other input to multiplier 28 is the signal on line 29, $P_s$, which represents the throttle pressure set point or, in other words, the desired throttle pressure. The signal on line 29 can be obtained from a manually adjustable signal source so that it represents a manually preset value or it can be obtained from the output of a control circuit such as in U.S. Pat. No. 3,802,189 mentioned above, in which case the set point is adjusted so as to tend to maintain the opening of the throttle valve 22 at a constant value as load changes occur or, in other words, the sliding pressure mode of control.

Dividing the measurement $P_1$ by the throttle pressure $P_t$ as measured by the pressure measuring instrument 24 provides a ratio as represented by the signal on line 27 which is indicative of the opening of the valve 22.

Therefore, when that quantity is multiplied by the pressure set point $P_s$ in the multiplier 28, it provides on output line 30 a signal representative of $P_1P_s/P_t$ which represents the turbine demand or, in other words, the energy input rate to the turbine and hence the energy output rate of the boiler which would exist when the throttle pressure $P_t$ is at its desired value $P_s$ if the opening in valve 22 remains unchanged. Thus, the signal on line 30 may be considered as a demand signal representing the output required from the boiler under standard conditions of pressure and temperature as required to meet the load requirements of the turbine-generator at the existing throttle valve opening. Therefore, the fuel flow and air flow to the boiler may be proportioned to this value.

It will be evident that the load established by the turbine-generator combination which consists of turbine 48 and generator 46 is determined by the generation control shown as block 41 which is effective to position motor 42 and the mechanically coupled valve 22 so that the throttle valve opening in the steam output line 20 is adjusted to allow an increase or decrease in the steam flow from the boiler to the turbine to respectively increase or decrease the output of generator 46.

In order to establish a signal on line 31 which will provide an error signal input to fuel controller 12, there is provided as one input to the comparator 32 the signal from line 30 which represents the turbine demand. It is then advantageous for the comparator 32 to compare the turbine demand with the rate at which heat is supplied to the boiler 16. Therefore, the other input to the comparator 32 on line 33 may advantageously represent the heat release in the boiler 16. That signal is established by summing in the summer 34 the signal $P_1$ from line 23 and the signal $\dot{P}_d$ from line 62. The signal $P_1$ represents the steam flow from the boiler to the turbine as previously mentioned and the signal $\dot{P}_d$ represents the rate of change of the drum pressure. This latter signal is obtained by measuring the drum pressure as by measuring instrument 54 which provides on line 56 a signal representative of the drum pressure. That signal is differentiated by differentiator 60 to provide the signal on line 62.

Since the input to the controller 12 on line 31 (error signal $e_h$) represents the results of a comparison between the turbine demand and the heat release to the boiler, the controller can effectively control by the output signal on line 94 to motor 70 the rate of feed of coal from the coal mill 14 so that the controller can operate to maintain equality between the boiler input and the required boiler output as represented respectively by the signals on lines 33 and 30. Thus, the fuel feed is controlled in response to the error signal $e_h$ calculated in accordance with the following equation:

$$e_h = P_1(P_s/P_t) - (P_1 + \dot{P}_d) \quad (1)$$

From this equation it will be evident that when $\dot{P}_d$ is zero the condition necessary for equality is $P_s = P_t$. Thus the reset action incorporated in controller 12 along with the usual proportional and rate response will serve to assure that the throttle pressure will be controlled to its set point.

The heat release to the boiler 16 is a function of both the BTU content of the fuel and the rate at which the fuel is supplied to the boiler. Thus, it will be evident that the inferential measurement of the heat released to the boiler 16 by the summation of the signals $P_1$ and $\dot{P}_d$ will make the control system of this invention independent of the changes in BTU content of the fuel being supplied by the coal mill 14.

The control system of FIG. 1 may be modified to include feedforward signals which will provide dynamic compensation for the fact that stored energy must be added to the boiler as the load on the boiler is increased in order to take care of the needed increase in stored energy which results from the rise in drum pressure due to the increased pressure drop through the superheater 40 at higher loads. The feedforward signals which will help the controller 12 anticipate the required heat release to the boiler to accommodate these increases in the storage in the boiler required at higher loads are provided by the system shown in FIG. 2.

In FIG. 2 it is desired that the signal on line 31, error signal $e_h$, should be calculated in accordance with the following equation:

$$e_h = P_1\frac{P_s}{P_t} + \left[P_1\frac{\dot{P}_s}{P_t}\right]\left[P_1\frac{P_s}{P_t}\right] + \dot{P}_s - P_1 - \dot{P}_d \quad (2)$$

The first term of the above equation represents the signal supplied on line 30 as an output from the multiplier 28 just as is shown in FIG. 1. The two factors which make up the second term of the equation are introduced as shown in the block diagram of FIG. 2 by multiplication in the multiplier 68 of the first derivative of the demand signal as produced by block 66 and the demand signal itself. The output of multiplier 68 is then summed with the demand signal on line 30 in the summer 69 and the output of that summer on line 70 is then provided as one input to summer 72 where the signal $\dot{P}_s$ is added by virtue of the other input to the summer on line 74. The signal on line 74 is, as shown in FIG. 2, derived as an output from the differentiator 76 whose input is obtained from line 29 which carries a signal representative of signal $P_s$. Block 76 provides an output which is effective to change boiler input demand in anticipation of the large changes in stored energy required by changes to throttle pressure setpoint ($P_s$). The output of the summer 72 on line 78 then represents the first three terms of the above equation. The other two terms of the equation are then representative of the signal on line 33.

Figure 3:
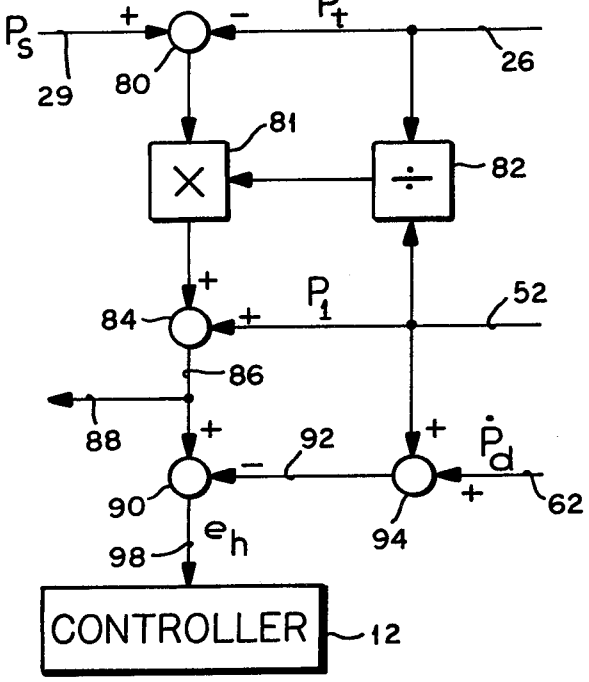
FIG. 3 is a block diagram of the variation of the control system of FIG. 1.

In FIG. 3 there is shown an arrangement for calculating $e_h$ as an input for controller 12 which produces the same control response as does the arrangement of FIG. 1. The equation which describes the calculation of $e_h$ as carried out by FIG. 3 is as follows:

$$e_h = \frac{P_1}{P_t}(P_s - P_t) + P_1 - (P_1 + \dot{P}_d) \quad (3)$$

The pressure error ($P_s - P_t$) is calculated by comparator 80 and the resulting value is multiplied by $P_1/P_t$ in multiplier 81. The quantity $P_1/P_t$ which is indicative of the throttle valve opening is calculated by the divider 82.

The output of multiplier 82 is then added by adder 84 to the signal $P_1$ supplied on line 52 to provide the demand signal on line 86. That demand signal is sent to the air flow control system over line 88 so that the air flow to support combustion is proportional to the rate of fuel supply to the boiler.

The demand signal on line 88 is also compared by comparator 90 with the heat release signal supplied on line 92 as an output of summer 94 which adds the signals $P_1$ and $P_d$. The result of the comparison in comparator 90 is the error signal $e_h$ which is supplied to fuel controller 12 over line 98.

Equation (3) can of course be reduced to $$e_h = P_1/P_t(P_s - P_t) - \dot{P}_d \quad (4)$$

thus showing that $e_h$ is equal to the throttle pressure deviation $(P_s - P_t)$ times the throttle valve position as represented by the quantity $P_1/P_t$ when $\dot{P}_d$ is zero. Thus, it may be said that the error to the fuel controller is the throttle pressure error adapted by the throttle valve position.

Figure 4:
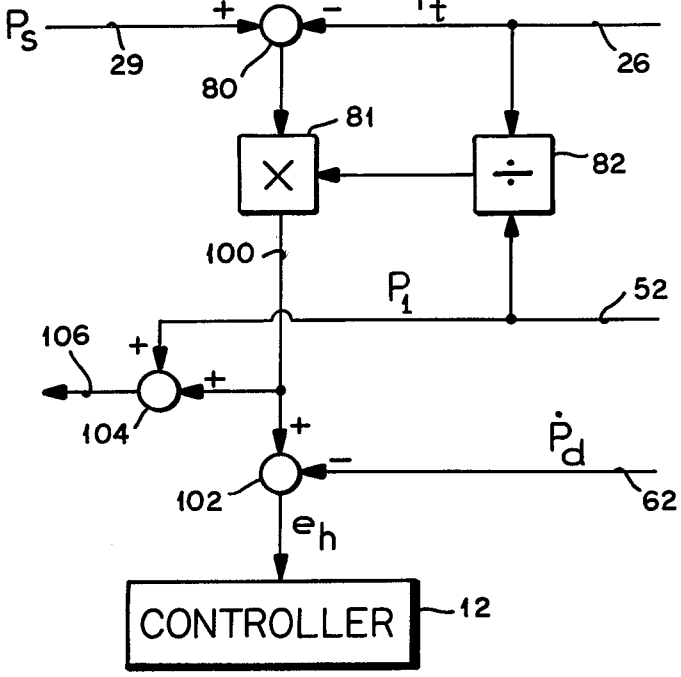
FIG. 4 is a block diagram of another variation of the control system of FIG. 1.

In FIG. 4 there is shown another variation of the arrangement of FIG. 1 for calculating $e_h$ which produces a result corresponding with that produced by FIG. 1. The arrangement of FIG. 4 may likewise be described by equation (4). It will be evident that the arrangement of FIG. 4 calculates the product $$P_1/P_t(P_s - P_t)$$

in the same manner as does FIG. 3. That product which appears on line 100 is then compared with $\dot{P}_d$ in comparator 102 to obtain the error signal input $e_h$ for controller 12. The signal on line 100 is also added in summer 104 to the signal $P_1$ from line 52 to produce a demand signal on line 106 for the air flow control.

It will be evident that the terms of equations (3) and (4) can be transposed to make equation (1). Thus, the equivalence of the systems of FIGS. 3 and 4 which determine $e_h$ in terms of throttle pressure error and the system of FIG. 1 show that the response of the fuel control to $P_s$ and $P_t$ in FIGS. 3 and 4 is effectively only to their ratio, namely $P_s/P_t$, as in FIG. 1 even though the terms of equations (3) and (4) include throttle pressure deviation times a quantity proportional to throttle valve opening.

While the present invention is described in connection with a system utilizing a single boiler connected to supply steam to a single turbine, it will be obvious to those familiar with the art that the invention is also applicable to industrial boilers, as mentioned, and also to both multiple boiler and multiple turbine systems. When used with multiple boiler systems, where a number of boilers supply steam to a common header which is in turn connected to a load such as a single turbine, a separate control system is supplied for each boiler. Each of those control systems has the quantity $P_1$ calculated as a desired fraction of the sum of the steam flow from each of the boilers when $P_1$ is multiplied by $P_s/P_t$. However, $P_1$ is the actual measured flow of steam from the boiler under control when $P_1$ is to be added to $\dot{P}_d$. Thus in equation (1) the value of $P_1$ in one case is a desired value and in the other case an actual measured value. Equation (1) can for this case be written $$e_h = P_{1d}\frac{P_s}{P_t} - (P_{1a} + \dot{P}_d)$$

where $P_{1d}$=desired value of $P_1$ and $P_{1a}$=actual value of $P_1$

For the purposes of this description the establishing of a quantity $P_1$ may be accomplished by setting a value desired for the rate of energy output from the boiler or it may be accomplished by measuring the value of the actual rate of energy output. Thus $P_1$ is intended to denote either $P_{1d}$ or $P_{1a}$ as may be required for carrying out the desired control of the boiler.

In control systems such as described in this application, the quantity $P_1$ may be any of a number of quantities all of which are indicative of the rate of energy flow from the boiler; namely steam flow, first stage pressure in the turbine, or megawatt output of the generator.

What is claimed is:

1. The method for controlling the boiler outlet pressure of a fuel fired drum type boiler connected to supply steam through a throttle valve to a turbine-generator, which comprises the steps of:

measuring a quantity $P_1$ indicative of the rate of energy input to the turbine;

measuring a quantity $P_t$ indicative of the actual throttle pressure;

providing a quantity $P_s$ indicative of the desired throttle pressure;

measuring a quantity $\dot{P}_d$ indicative of the rate of change of the drum pressure; and controlling the fuel input to the boiler so as to vary the heat released in the boiler as represented by the expression $$P_1 + \dot{P}_d$$

in accordance with a demand quantity represented by the expression $$P_1(P_s/P_t)$$

indicative of the energy input rate to the turbine which will occur at the existing throttle valve opening when throttle pressure is at its desired value so that effectively the response of the control action to $P_s$ and $P_t$ is only to their ratio.

2. The method for controlling the boiler outlet pressure of a fuel fired drum type boiler connected to supply steam to a load, which comprises the steps of:

establishing a quantity $P_1$ indicative of the rate of energy output from the boiler;

measuring a quantity $P_t$ indicative of the actual outlet pressure;

providing a quantity $P_s$ indicative of the desired outlet pressure;

measuring a quantity $\dot{P}_d$ indicative of the rate of change of the drum pressure; and determining a demand quantity indicative of the energy output rate from the boiler which will exist when outlet pressure is at its desired value, said demand being calculated in accordance with the expression, $$P_1(P_s/P_t); \text{ and}$$

controlling the fuel input to the boiler so as to vary the heat released in the boiler in accordance with said demand quantity, said heat release being calculated in accordance with the expression $$P_1 + \dot{P}_d.$$

3. The method for controlling the boiler outlet pressure of a fuel fired drum type boiler connected to supply steam to a load, which comprises the steps of:

establishing a quantity $P_1$ indicative of the rate of energy output from the boiler;

measuring a quantity $P_t$ indicative of the actual outlet pressure;

providing a quantity $P_s$ indicative of the desired outlet pressure;

determining from said last named quantity a quantity $\dot{P}_s$ indicative of the rate of change of the quantity $P_s$;

calculating a dynamic compensation quantity in accordance with the expression $$\left[P_1\frac{P_d}{P_t}\right]\left[P_1\frac{P_s}{P_t}\right]+\dot{P}_s$$

which is indicative of the required stored energy change in the boiler necessary for different levels of boiler output;

measuring a quantity $\dot{P}_d$ indicative of the rate of change of the drum pressure; and controlling the fuel input to the boiler so as to vary the heat released in the boiler as represented by the expression $$P_1+\dot{P}_d$$

in accordance with a modified demand quantity indicative of the energy output rate from the boiler when the outlet pressure equals the desired value as that quantity is modified by the dynamic compensation term where the modified demand quantity is in accordance with the expression $$P_1\frac{P_s}{P_t}+\left[P_1\frac{P_s}{P_t}\right]\left[P_1\frac{P_s}{P_t}\right]+\dot{P}_s$$

so that the response of the control action to $P_s$ and $P_t$ is effectively only to their ratio.

4. The method for controlling the throttle pressure of a fuel fired drum type boiler connected to supply steam through a throttle valve to a turbine-generator, which comprises the steps of:

measuring a quantity $P_1$ indicative of the rate of energy input to the turbine;

measuring a quantity $P_t$ indicative of the actual throttle pressure;

providing a quantity $P_s$ indicative of the desired throttle pressure;

measuring a quantity $\dot{P}_d$ indicative of the rate of change of the drum pressure; and calculating throttle valve position in accordance with the expression $$P_1/P_t;$$

calculating throttle pressure error in accordance with the expression $$P_s-P_t;$$

calculating the heat released to the boiler by the fuel in accordance with the expression $$P_1+\dot{P}_d; \text{ and}$$

controlling the fuel input so as to tend to reduce to zero the quantity obtained by multiplying the calculated throttle valve position by the calculated throttle pressure error, adding the quantity $P_1$, and subtracting the calculated heat release.

5. The method for controlling the throttle pressure of a fuel fired drum type boiler connected to supply steam through a throttle valve to a turbine-generator, which comprises the steps of:

measuring a quantity $P_1$ indicative of the rate of energy input to the turbine;

measuring a quantity $P_t$ indicative of the actual throttle pressure;

providing a quantity $P_s$ indicative of the desired throttle pressure;

measuring a quantity $\dot{P}_d$ indicative of the rate of change of the drum pressure; and calculating throttle valve position in accordance with the expression $$P_1/P_t;$$

calculating throttle pressure error in accordance with the expression $$P_s-P_t; \text{ and}$$

controlling the fuel input so as to tend to reduce to zero the quantity obtained by multiplying the calculated throttle valve position by the calculated throttle pressure error and subtracting the quantity $\dot{P}_d$.

6. Apparatus for controlling the boiler outlet pressure of a fuel fired drum type boiler connected to supply steam to a load comprising:

means for measuring a quantity $P_{1d}$ indicative of the magnitude of that portion of the total flow of steam to the load desired from the boiler;

means for measuring a quantity $P_{1a}$ indicative of the magnitude of the actual steam flow from the boiler;

means for measuring a quantity $P_t$ indicative of the actual boiler outlet pressure;

means for measuring a quantity $\dot{P}_d$ indicative of the rate of change of the drum pressure; and means for providing a quantity $P_s$ indicative of the desired outlet pressure;

means for controlling the fuel input to the boiler so as to vary the heat released in the boiler as represented by the expression $$P_{1a}+\dot{P}_d$$

in accordance with a demand quantity represented by the expression $$P_{1d}(P_s/P_t)$$

indicative of the steam flow desired from the boiler when outlet pressure is at its desired value so that effectively the response of the control action to $P_s$ and $P_t$ is only to their ratio.

7. Apparatus for controlling the boiler outlet pressure of a fuel fired drum type boiler connected to steam supply to a load, comprising:

means for establishing a quantity $P_1$ indicative of the rate of energy flow from the boiler;

means for measuring a quantity $P_t$ indicative of the actual outlet pressure;

means for providing a quantity $P_s$ indicative of the desired outlet pressure;

means for measuring a quantity $\dot{P}_d$ indicative of the rate of change of the drum pressure; and means for controlling the fuel input to the boiler so as to vary the heat released in the boiler as represented by the expression $$P_1+\dot{P}_d$$

in accordance with a demand quantity represented by the expression $$P_1(P_s/P_t)$$

indicative of the energy output rate from the boiler which will occur when outlet pressure is at its desired value so that effectively the response of the control action to $P_s$ and $P_t$ is only to their ratio.

8. Apparatus for controlling the outlet pressure of a fuel fired drum type boiler connected to supply steam to a load, comprising:

means for establishing a quantity $P_1$ indicative of the rate of energy output from the boiler;

means for measuring a quantity $P_t$ indicative of the actual outlet pressure;

means for providing a quantity $P_s$ indicative of the desired outlet pressure;

means for determining from said last named quantity a quantity $\dot{P}_s$ indicative of the rate of change of the quantity $P_s$;

means for calculating a dynamic compensation quantity in accordance with the expression $$\left[P_1\frac{P_d}{P_t}\right]\left[P_1\frac{P_s}{P_t}\right]+\dot{P}_s$$

which is indicative of the required stored energy change in the boiler necessary for different levels of boiler output;

means for measuring a quantity $\dot{P}_d$ indicative of the rate of change of the drum pressure; and means for controlling the fuel input to the boiler so as to vary the heat released in the boiler as represented by the expression $$P_1+\dot{P}_d$$

in accordance with a modified demand quantity indicative of the energy output rate of the boiler when the outlet pressure equals the desired value as that quantity is modified by the dynamic compensation term where the modified demand quantity is in accordance with the expression $$P_1\frac{P_s}{P_t}+\left[P_1\frac{P_s}{P_t}\right]\left[P_1\frac{P_s}{P_t}\right]+\dot{P}_s$$

so that the response of the control action to $P_s$ and $P_t$ is effectively only to their ratio.

9. The method for controlling the boiler outlet pressure of a fuel fired drum type boiler connected to supply steam to a load which comprises the steps of:

establishing a quantity $P_1$ indicative of the magnitude of the total rate of flow of energy from the boiler;

measuring a quantity $P_t$ indicative of the actual boiler outlet pressure;

measuring a quantity $\dot{P}_d$ indicative of the rate of change of the drum pressure; and providing a quantity $P_s$ indicative of the desired outlet pressure;

controlling the fuel input to the boiler so as to vary the heat released in the boiler, calculated in accordance with expression $$P_1+\dot{P}_d,$$

to follow a demand quantity calculated in accordance with expression $$P_1(P_s/P_t),$$

so that effectively the response of the control action to $P_s$ and $P_t$ is only to their ratio.

* * * * *